US005791919A

United States Patent [19]

Brisson et al.

[11] Patent Number: 5,791,919

[45] Date of Patent: Aug. 11, 1998

[54] UNIVERSAL CONNECTOR

[75] Inventors: Bruce A. Brisson; Timothy A. Brisson, both of Auburn; Bruce A. Eastes, Citrus Heights; James D. Hassi, Grass Valley, all of Calif.

[73] Assignee: Constant Velocity Transmission Lines, Inc., Auburn, Calif.

[21] Appl. No.: 640,084

[22] Filed: Apr. 30, 1996

[51] Int. Cl.[6] ..... H01R 11/12; H01R 11/18

[52] U.S. Cl. ..... 439/166; 439/891

[58] Field of Search ..... 439/166–175, 439/957, 891

[56] References Cited

U.S. PATENT DOCUMENTS

| | | | |
|---|---|---|---|
| 1,188,055 | 6/1916 | Faile | 439/874 |
| 4,367,001 | 1/1983 | Munakata | 439/175 |
| 4,440,464 | 4/1984 | Spinner | 439/218 |
| 4,944,686 | 7/1990 | Gertz | 439/177 |
| 5,083,935 | 1/1992 | Herman | 439/433 |

*Primary Examiner*—Neil Abrams

[57] ABSTRACT

An electrical connector is set forth which is suitable for connection to a conductor which includes a connector member suitable for attachment, for example by soldering or by a crimping device, to a conductor, such as a cable. The electrical connector also includes a terminal pin connectable to an electrical receptor or terminal, for example in a part of an audio system. The connector member also includes a threaded part onto which any one of several types of alternative connector units may be mounted to enable use of the same conductor and its attached connector with different types of audio system receptors or terminals. A right-angle adapter may also be used to join the electrical connector to one of the alternative connector units.

28 Claims, 3 Drawing Sheets

UNIVERSAL CONNECTOR

FIELD OF INVENTION

This invention relates to audio speaker cable and connectors, specifically to a new and novel type of connector.

BACKGROUND OF INVENTION

Since the late 1970's, upgrade speaker cables for the consumer electronics market have been available and are becoming more and more popular. Rather than being content with the cable supplied by speaker or amplifier manufacturers with their equipment, consumers have opted for more robust cables and connectors. Once sold only in High End "salon"-style dealers, upscale speaker cables are now seen in mass-market chains across the United States and throughout the world.

However, unlike the "RCA" connector that is industry-standard on interconnect cables for line-level equipment such as CD players and the like, there exists no standard for speaker cable connectors. Therefore, one connector does not fit all audio amplifiers and speakers on the market. This has generated much frustration and inconvenience for consumers, and a great waste of time, money, and resources for manufacturers and dealers.

This is because connectors are generally affixed to speaker cables by soldering or crimping, making the connectors impossible to change quickly or efficiently. Therefore, in order to cope with the wide variety of connectors available, dealers and manufacturers alike must stock large inventories of speaker cable terminated with different connectors, and different combinations of connectors, in order to respond to special orders by customers.

Inevitably, a customer will order an audio system requiring speaker cables having a unique combination of connectors that the dealer or manufacturer did not have the foresight to stock. In this case, a new cable must be manufactured from scratch, or, a finished good must be taken from stock and re-terminated to the customers' specifications. Either option creates a special order having several disadvantages:

a) Special orders are costly because they utilize factory space and resources inefficiently. Manufacturers typically organize factories to handle large quantities in order to reduce costs and overhead. When a factory receives a special order, however, it will be processed alone, thereby bypassing the advantages built into the factory.

b) Re-terminating finished goods is wasteful. The labor expended to unpack, re-terminate, and repack the cables is wasted, as are the connectors originally on the cable and the solder and energy used to affix them.

c) Special orders invariably are rush orders and will be shipped by fast freight, which is very costly.

d) Sales are lost if a customer is unwilling to wait for a special order to be processed.

One type of connector has been used to try and alleviate the need for special orders, the twist-on connector. For example, The Monster Cable Company markets such a connector under the name Twist-Crimp. Similar to an electrician's wire nut with an audio connector such as a pin on one end, it affixes directly to the conductor of a speaker cable via a threaded twisting mechanism. However, the quality of the connection achieved by twist-on connectors is not acceptable for High End audio.

First, the physical connection of a twist-on connector is not permanent and is prone to coming loose. Many users report that the speaker cables pull out of the twist-on connector and fall off the back of their speaker, leaving bare wires on the floor a potentially dangerous situation.

Second, listeners report loss of sonic quality when comparing twist-on connectors to standard soldered-on connectors. The present inventors feel that because crimp-on type connectors must affix themselves to the conductor by digging in with knife-edges, adequate surface area contact is not made between the connector and conductor. This limits current flow and degrades the sound of the audio system. Also, the joint between the connector and conductor leaves bare copper conductor exposed, possibly leading to corrosion and further degrading the sound of the audio system.

While perhaps satisfactory for entry-level systems, because of the lack of both physical sturdiness and sonic quality, twist-on connectors are not acceptable for High End audio speaker cables.

Solutions to the above set forth problems would be highly desirable.

OBJECTS AND ADVANTAGES

Some objects and advantages of the present invention are:

a) to provide a connector which can be quickly changed without the use of tools or solder;

b) to provide a connector that will allow manufacturers and dealers to greatly simplify inventory planning and keep inventories as low and effective as possible;

c) to provide a connector that will eliminate the need to re-terminate finished goods in order to meet customers orders, thereby reducing special orders and potentially increasing sales;

d) to provide a connector that will allow a customer to adapt speaker cable to future upgrades of equipment; and e) to accomplish the above objects while insuring sonic quality and physical sturdiness remain as high as possible.

Still further objects and advantages will become apparent from the ensuing drawings and operation descriptions.

SUMMARY OF THE INVENTION

In accordance with an embodiment of the invention an electrical connector is set forth which is suitable for connection to a conductor which has an attachment end portion and to an electrical receptor. The connector comprises a longitudinally extending member having a proximal end portion and a distal end portion. The proximal end portion of the member has a first structure adapted to be rigidly attached in electrical conducting and mechanically supported relation to the attachment end portion of the conductor. The distal end portion of the member has an attachment structure. A connector unit has a proximal end portion and a distal end portion. The proximal end portion of the connector unit has a second structure which is adapted to be attached in electrical conducting and mechanically supported relation to the attachment structure. The distal end portion of the connector unit has a structure adapted to be connected to the electrical receptor. The electrical connector is particularly useful with speaker cable of an audio system.

In accordance with another embodiment of the invention a connector of the nature discussed above is mounted to an audio cable.

The above set forth and other desirable objectives are accomplished utilizing the connector and connector/cable wet forth above.

DRAWINGS

The invention will be further understood by reference to the Figures of the Drawings wherein like numbers denote like parts throughout and wherein.

Figure 1:
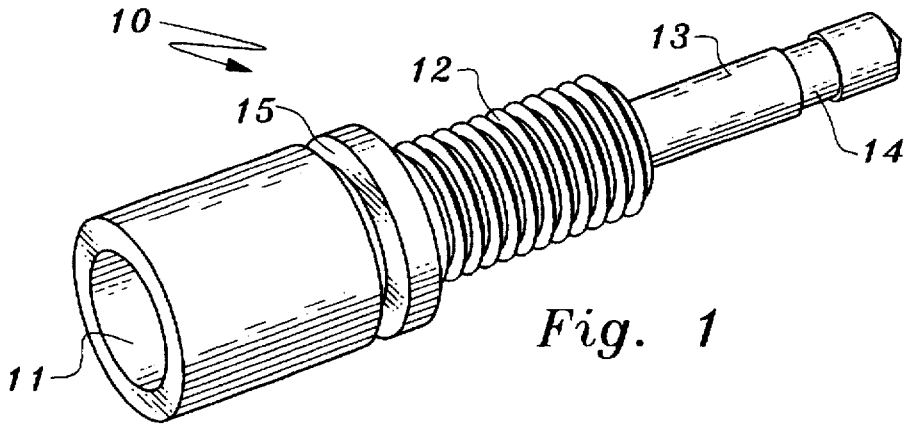
FIG. 1 shows a universal base-pin connector suitable for soldering to a speaker cable.
Figure 3:
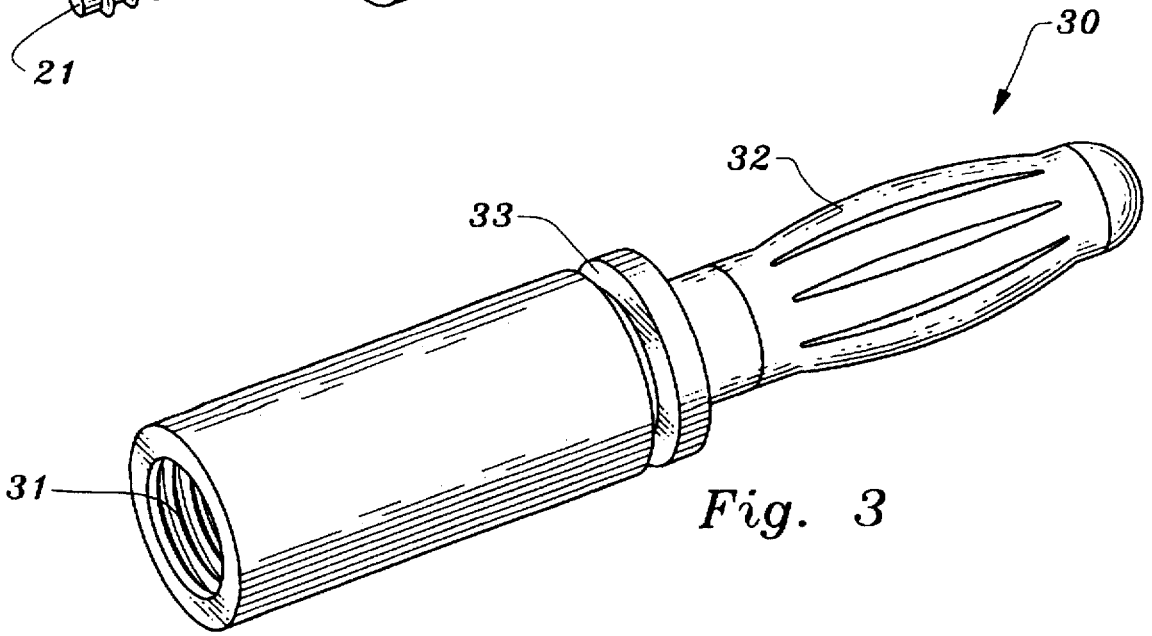
FIG. 3 shows a banana connector suitable for attaching to the universal base units depicted in FIGS. 1 and 2.
Figure 4:
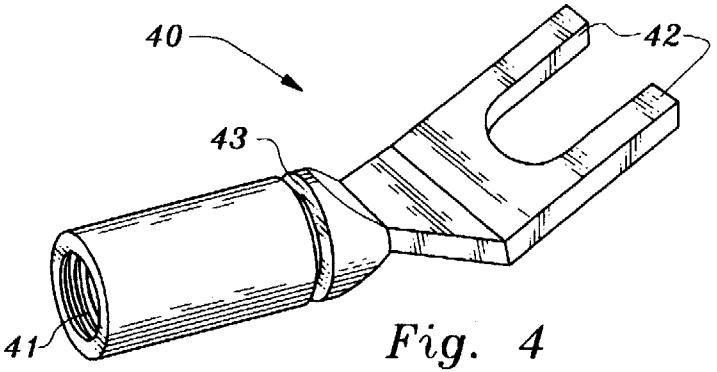
FIG. 4 shows a spade connector suitable for attaching to the universal base units depicted in FIGS. 1 and 2.
Figure 6A:
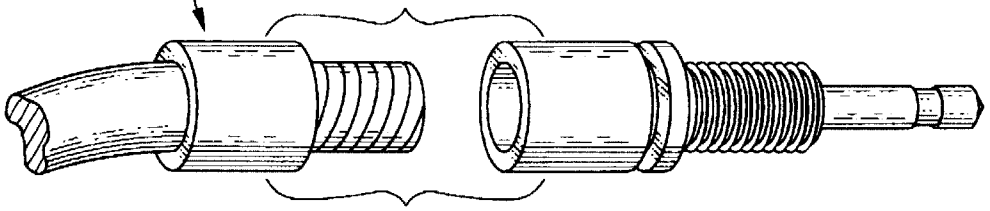
Figure 6:
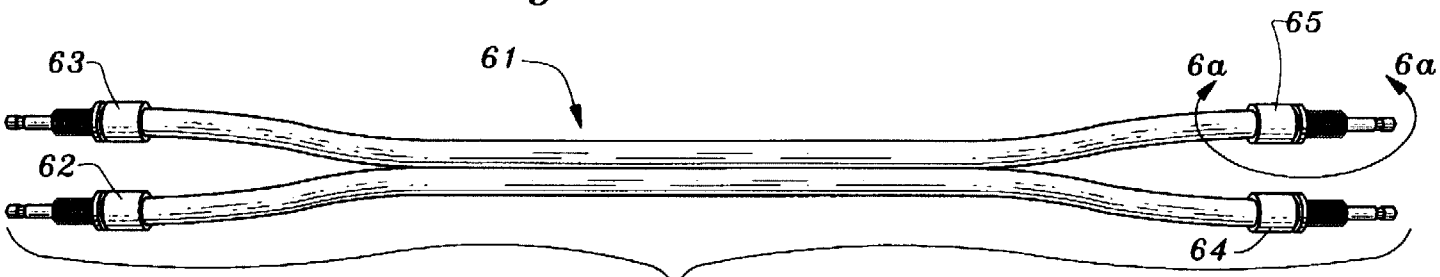
Figure 7:
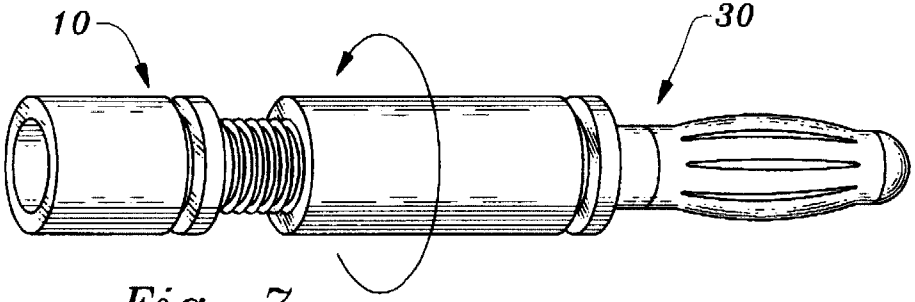
Figure 8:
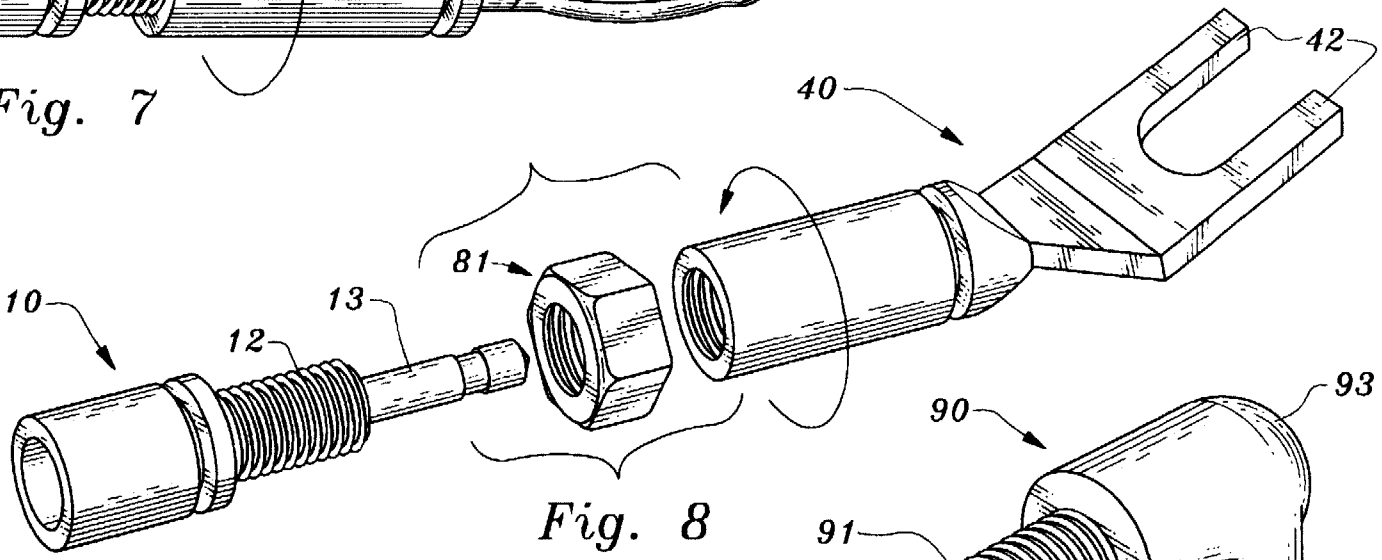
Figure 9:
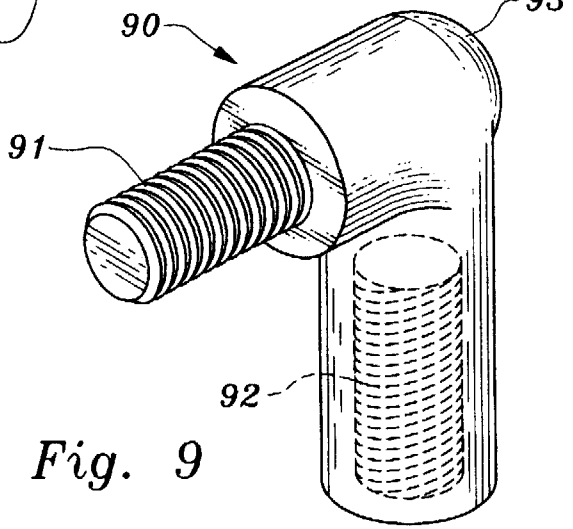

FIGS. 6 and 6*a* show a speaker cable with the universal base depicted in FIG. 1 attached;

FIG. 7 details affixing the banana connector depicted in FIG. 3 to the speaker cable/base unit assembly depicted in FIG. 6;

FIG. 8 details affixing the spade connector depicted in FIG. 4 to the speaker cable/base unit assembly depicted in FIG. 6 and aligning the spade connector with a nut; and FIG. 9 shows a right-angle adapter suitable for adding convenience to the present invention.

DETAILED DESCRIPTION

FIGS. 1 to 5

FIG. 1 shows a typical embodiment of a universal solderable base connector 10 in accordance with an embodiment of the invention. In a working embodiment of FIG. 1, the solderable base 10 was fashioned from brass and plated with gold. In another working embodiment of FIG. 1, the solderable base 10 was fashioned from brass and plated with a nickel undercoat and a gold overcoat. The solderable base 10 features, at its proximal (the terms "proximal" and "distal" are used herein to refer to, respectively, nearness and distance from a cable to which the part connects either directly or through another member) end portion, a recess 11 for the insertion and soldering of an electrical conductor. A set of threads 12 are machined on the solderable base 10 to facilitate the affixing of connectors to be described later. In a working embodiment of FIG. 1, the threads 12 were of a standard 8/32 type. The solderable base 10 also features, at its distal end portion, a standard audio pin connector 13 further featuring a notch 14. Pin 13 and notch 14 facilitate attaching the solderable base 10 to any standard audio amplifier or speaker. Finally, the solderable base 10 features a second notch 15 to facilitate attaching an insulating cover, not shown.

Figure 2:
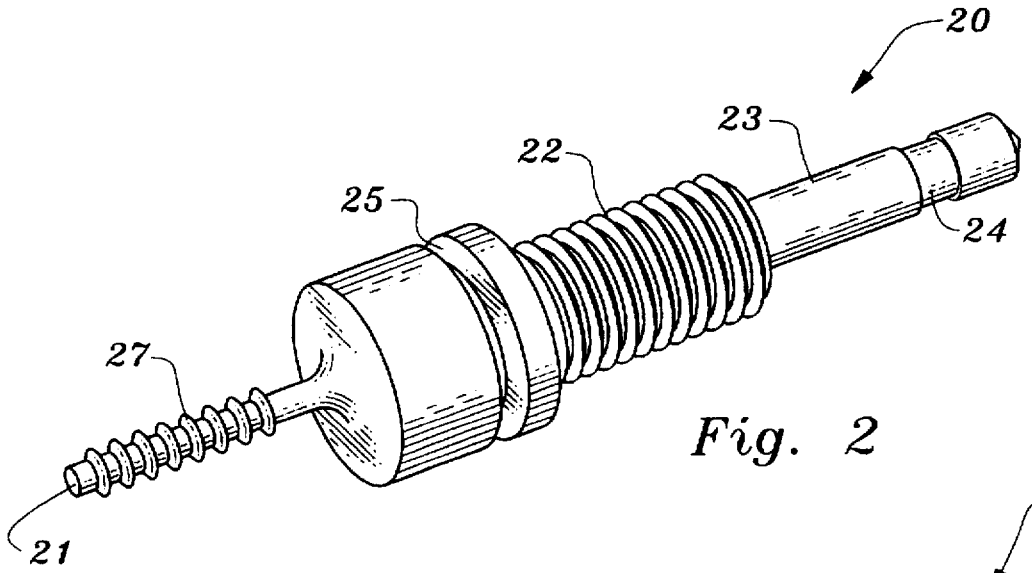
FIG. 2 shows a universal base-pin connector suitable for crimping to a speaker cable.

FIG. 2 shows a typical embodiment of a universal crimpable base connector 20. In a working embodiment of FIG. 2, the crimpable base 20 was fashioned from brass and plated with gold. In another working embodiment of FIG. 2, the crimpable base 20 was fashioned from brass and plated with a nickel undercoat and a gold overcoat. The crimpable base 20 features, at its proximal end portion, a post 21 which may include ridges 27. The ridges 27 assist in preventing a cable or other conductor that is connected to the crimpable base connector 20 by the crimping method commonly used in the industry, from slipping off or otherwise coming loose, from the post 21 together with an electrical conductor. A set of threads 22 are machined on the crimpable base 20 to facilitate the affixing of connectors to be described later. In a working embodiment of FIG. 2, the threads 22 were of a standard 8/32 type. The crimpable base 20 also features a standard audio pin connector 23, at its distal end portion, further featuring a notch 24. Pin 23 and notch 24 facilitate attaching the crimpable base 20 to any audio amplifier or speaker. Finally, the crimpable base 20 features a second notch 25 to facilitate attaching an insulating cover, not shown.

FIG. 3 shows a banana connector 30. Banana connector 30 features a set of female threads 31, at its proximal end portion, machined internally. A working embodiment of banana connector 30 was fashioned from brass a plated with gold. A second working embodiment of banana connector 30 was fashioned from brass a plated with an undercoat of nickel and an overcoat of gold. Threads 31 facilitate affixing banana connector 30 to the threads 11 of solderable base 10 of FIG. 1 or to the threads 22 of crimpable base 20 of FIG. 2. In a working embodiment of banana connector 30, the threads 31 were of a standard 8/32 type. Banana connector 30 also features a set of standard audio lams 32 at its distal end portion. Lams 32 allow banana connector 30 to be inserted and affixed into a standard female banana receptacle, such as those found on audio amplifiers and speakers. Finally, banana connector 30 features a notch 33 to facilitate attaching an insulating cover, not shown.

FIG. 4 shows a machined spade connector 40. Spade connector 40 features a set of female threads 41 machined internally at its proximal end portion. A working embodiment of spade connector 40 was fashioned from brass a plated with gold. A second working embodiment of spade connector 40 was fashioned from brass a plated with an undercoat of nickel and an overcoat of gold. Threads 41 facilitate affixing spade connector 40 to the threads 11 of solderable base 10 of FIG. 1 or to the threads 22 of crimpable base 20. In a working embodiment of spade connector 40, the threads 41 were of a standard 8/32 type. Spade connector 40 also features a set of standard spade tines 42 at its distal end portion. Tines 42 allow spade connector 40 to be inserted and affixed into a standard audio binding post, such as those found on audio amplifiers and speakers. Finally, spade connector 40 features a notch 43 to facilitate attaching an insulating cover, not shown.

Figure 5:
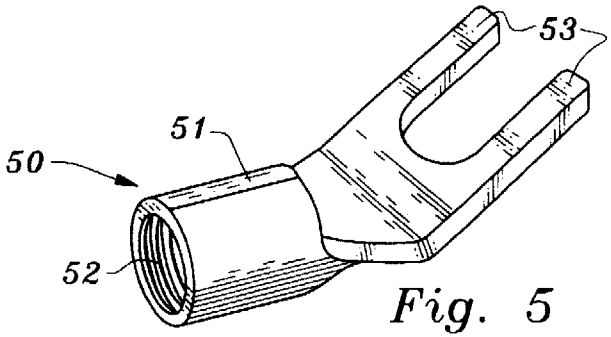
FIG. 5 shows an economical spade connector suitable for attaching to the universal base units depicted in FIGS. 1 and 2.

FIG. 5 shows an economical stamped spade connector 50. Spade connector 50 features a tube 51 formed by a metal stamping or similar process at its proximal end portion. Inside of tube 51 a set of female threads 52 are tapped. A working embodiment of spade connector 50 was fashioned from brass a plated with gold. A second working embodiment of spade connector 50 was fashioned from brass a plated with an undercoat of nickel and an overcoat of gold. Threads 52 facilitate affixing spade connector 50 to the threads 11 of solderable base 10 of FIG. 1 or to the threads 22 of crimpable base 20. In a working embodiment of spade connector 50, the threads 52 were of a standard 8/32 type. Spade connector 50 also features a set of standard spade tines 53 at its distal end portion. Tines 53 allow spade connector 50 to be inserted and affixed into a standard audio binding post, such as those found on audio amplifiers and speakers.

FIGS. 6 to 9

FIGS. 6, 6*a* show how the embodiment of the invention depicted in FIG. 1 is intended to be implemented, resulting in a finished speaker cable assembly 60. Assembly 60 can be finished at a factory, a factory-trained dealer, or by an end user sufficiently skilled in soldering and/or cable preparation techniques. Ideally, the following steps would be executed to prepare assembly 60:

(1) A speaker cable conductor 61 of suitable length is selected. A normal side-by-side conductor is depicted, however, any electrical conductor suitable for transporting electrical current will suffice.

(2) The four ends of conductor 61 must be prepared to be inserted into recess 11 of solderable bases 62, 63, 64, and 65 by removing sufficient insulation 66 as shown in FIG. 6*a*.

(3) Solderable bases 62, 63, 64, and 65 are now soldered onto conductor 61 using normal soldering techniques. If crimpable base 20, of FIG. 2, had been chosen instead of solderable base 10, then bases 62, 63, 64, and 65 would be crimped onto the ends of conductor 61 by using a hand crimper or other suitable device.

(4) Since the base units 10 and 20 feature a standard audio pin 13 and 23, assembly 60 is now complete for use in connecting an audio amplifier to a speaker.

FIGS. 6–8, along with three potential situations, further illustrate the operational advantages of the present invention:

(1) if a different connector, such as banana connector 30, is desired, an end user of any skill level can simply screw on a connector of their choice as shown in FIG. 7. Since finger-tightness is all that is required to secure the two together, no tools are required for this operation. FIG. 7 shows banana connector 30 being screwed onto solderable base 10; or (2) if the end user later purchases a new speaker that only accepts spade connectors, a situation common in the High End audio market, the end user can then unscrew and remove banana connector 30, purchase spade connector 40, and affix it as shown in FIG. 8. Nut 81 is provided to assist in aligning tines 42 to be flush with the binding post and back of the speakers to which spade connector 40 is attached, as the addition of the nut 81 at an appropriate location along the threads below the spade connector 40 may impede the spade connector's 40 additional rotation, and thus prevent the tines 42 from moving out of alignment. If the end user is budget-minded, spade connector 50 can be substituted.

FIG. 9 shows a right-angle adapter 90 that overcomes an inconvenience found in many modern home-theater entertainment systems. Central to common home-theater entertainment systems is the surround-sound receiver. In most homes, the receiver is installed in an entertainment center placed close to a wall. Since the speaker cable output terminals are located on the back of the receiver, installing speaker cables can often be difficult, as one must run the speaker cable up from the floor and form a right angle bend to insert the speaker cable connector into the receiver. This bend is often right up against the wall. Also, the mechanical stress created by the right angle can shear and break a soldered connection. Adapter 90 reduces this shear and adds convenience by facilitating a right-angle bend prior to connection to the receiver. Provided on the distal end portion of adaptor 90 is a set of male mechanical threads 91 suitable for affixing to a connector such as a banana 30, and a set of recessed female mechanical threads 92 on the proximal end portion of adaptor 90 which are suitable for connection to a base unit such as solderable base 10. A working embodiment of adapter 90 was formed from a solid brass body 93. Body 93 was machined from a solid brass extrusion which was first miter-cut to form a 90° joint. The two pieces were then secured together by welding with silver solder to ensure proper sonic quality. Adaptor 90 was then plated with gold.

RAMIFICATIONS, SUMMARY AND SCOPE

The practical ramifications of the present invention are great in scope, especially to cable factories. The present inventors, for example, manage a speaker cable factory. During a recent month, they re-terminated nearly 200 pairs of speaker cables in order to meet special orders. Since there are a minimum of eight terminations per speaker cable, at least 1,600 separate terminations had to be performed. The inventors fully expect the present invention to nearly eliminate special orders, thereby resulting in significant savings.

Accordingly, and in light of the descriptions accompanying the figures and operation detail given above, the reader will also see additional advantages of the universal connector system in that a) the invention is both novel and practical;

b) factories and dealers implementing the present invention will save money and streamline operations and inventory which can be expected to, in turn, lower the cost to the consumer;

c) it permits factories to manufacture new and different types of connectors that are compatible with existing speaker cables already on the market; and d) it allows dealers as well as end users to upgrade or replace broken connectors quickly and easily, and in some cases without the use of tools or soldering.

Although the descriptions above contain many specificities, these should not be construed as limiting the scope of the invention but as merely providing illustrations of some of the presently preferred embodiments of this invention. For example, the universal bases may be affixed to electrical conductors through different means than the crimping or soldering methods described. Sonic welding, resistance welding and other equivalents have been investigated. Any means, manual or automated, that bonds, affixes, or otherwise attaches the base to a conductor and allows electrical current or signals to properly flow and provide adequate mechanical support is satisfactory for the scope of this invention.

Also, types of audio connectors other than the spade, pin, and banana types described herein may exist or be created in the future. After all, a specific object of the present invention is to allow manufacturers to meet the needs of ever-changing markets. Also, accessory devices that would affix between the base and connector units and extend the reach of the system or allow connection at an angle or otherwise add convenience to the connection process have been considered by the present inventors and would be appreciated by one normally skilled in the art. Thus, terms such as connector unit and the like should be understood to potentially include multi-piece units which can include one or more spacers or other accessory devices. Accordingly, any connecting means that allows an electrical conductor to be attached to a device enabling signal or current flow to or from that device is intended to fall within the scope of this invention.

Furthermore, different materials other than the brass used for the present embodiments may be used for the construction of the present invention. Brass was chosen because of cost and ease-of-use issues, but any material suitable for signal or current flow may be used. These materials could include, but should not limited to: copper and copper variants, gold, silver, and aluminum.

The plating of the materials should not limit the scope of the present invention, either. Again, for cost and other reasons, the inventors chose to use gold and gold-over-nickel plating for the present embodiments. However, any plating material or process may be used so as to not interfere with signal or current flow. Such processes could include, but should not be limited to, exotic plating materials such as platinum or rhodium, or processes the give the invention a distinctive appearance or feel.

Also, the mechanical threads used to affix the connector to the base should not limit the scope of the present invention. As one normally skilled in the art would appreciate, there exists a wide variety of ways and means to connect the connector and base other than the mechanical threads described herein. For example, a spring-lock or snap arrangement might be used.

Furthermore, it is conceivable that an end user might desire to make the union of base and connector permanent, even though this negates the universality of the present invention. In this case one might solder, weld, or otherwise permanently join the base and connector. This permanent joining could be in addition to mechanical threads or other mechanical joining means, or suffice in and of itself.

Finally, while the present embodiment shows the base having a male mechanical thread and the connector having a female thread, one might see reason to manufacture the opposite-the base having a female thread and the connector having a male thread. Any means that affixes a connector to a base and enables proper signal or current flow is intended to fall within the scope of the present invention.

Accordingly, the scope of the present invention should be determined by the claims that follow, and not by the examples given.

That which is claimed is:

1. An electrical connector suitable for connection to a conductor which has an attachment end portion and to an electrical receptor, the electrical connector comprising:

a longitudinally extending member having a proximal end portion and a distal end portion, the proximal end portion of the member having a conductor attachment structure adapted to be rigidly attached in electrical conducting and mechanically supported relation to the attachment end portion of the conductor, the distal end portion of the member having a single pole first connector unit attachment structure and further having a first electrical connection structure forming a standard rigid pin connector; and a connector unit having a proximal end portion and a distal end portion, the proximal end portion of the connector unit having a second connector unit attachment structure adapted to be attached in electrical conducting and mechanically supported relation to the first connector unit attachment structure without removal of the first electrical connection structure, the distal end portion of the connector unit having a second electrical connection structure, which second electrical connection structure is not a standard rigid pin connector, whereby the first electrical connection structure may be joined to an electrical receptor of the pin receiving type, or the member and connector unit may be joined and the second electrical connection structure may then be joined to an electrical receptor of suitable type.

2. An electrical connector as set forth in claim 1, wherein the conductor is an audio cable.

3. An electrical connector as set forth in claim 2, wherein the conductor attachment structure is a first bore extending into the proximal end portion of the longitudinally extending member and the rigid attaching is via a solder connection.

4. An electrical connector as set forth in claim 3, wherein the first connector unit attachment structure is a shaft and the second connector unit attachment structure is a second bore adapted to engage about the shaft.

5. An electrical connector as set forth in claim 4, wherein the shaft is threaded and the second bore is threaded so as to matingly engage with the threads on the shaft.

6. An electrical connector as set forth in claim 1, wherein the conductor attachment structure is a first bore extending into the proximal end portion of the longitudinally extending member and the rigid attaching is via a solder connection.

7. An electrical connector as set forth in claim 1, wherein the first connector unit attachment structure is a shaft and the second connector unit attachment structure is a bore adapted to engage about the shaft.

8. An electrical connector as set forth in claim 7, wherein the shaft is threaded and the second bore is threaded so as to matingly engage with the threads on the shaft.

9. An electrical connector as set forth in claim 1, wherein the first structure is a proximally extending post adapted for attachment to the conductor by crimping and the rigid attaching is via crimping of the conductor to the post.

10. An electrical connector as set forth in claim 9, wherein the first connector unit attachment structure is a shaft and the second connector unit attachment structure is a second bore adapted to engage about the shaft.

11. An electrical connector as set forth in claim 10, wherein the shaft is threaded and the second bore is threaded so as to matingly engage with the threads on the shaft.

12. An electrical connector as set forth in claim 9, wherein the conductor is an audio cable.

13. An electrical connector as set forth in claim 12, wherein the first connector unit attachment structure is a shaft and the second connector unit attachment structure is a second bore adapted to engage about the shaft.

14. An electrical connector as set forth in claim 13, wherein the shaft is threaded and the second bore is threaded so as to matingly engage with the threads on the shaft.

15. An electrical connector as set forth in claim 1, wherein the second electrical receptor connection structure is a spade connector or a banana connector.

16. An electrical connector as set forth in claim 2, wherein the electrical receptor is on a speaker.

17. An electrical connector as set forth in claim 12, wherein the electrical receptor is on a speaker.

18. An electrical connector suitable for connection to a conductor which has an attachment end portion and to an electrical receptor, the electrical connector comprising:

a longitudinally extending member having a proximal end portion and a distal end portion, the proximal end portion of the member having a conductor attachment structure adapted to be rigidly attached in electrical conducting and mechanically supported relation to the attachment end portion of the conductor, the distal end portion of the member having a first adapter unit attachment structure and further having a first electrical connection structure;

an adapter unit, comprising a member which forms a right angle, and having a proximal end portion and a distal end portion, the proximal end portion of the adapter unit having a second adapter unit attachment structure adapted to be attached in electrical conducting and mechanically supported relation to the first adapter unit attachment structure without removal of the first electrical connection structure, and the distal end portion of the adapter unit having a first connector unit attachment structure;

a connector unit having a proximal end portion and a distal end portion, the proximal end portion of the connector unit having a second connector unit attachment structure adapted to be attached in electrical conducting and mechanically supported relation to the first connector unit attachment structure, the distal end portion of the connector unit having a second electrical connection structure, whereby the first electrical connection structure may be joined to an electrical receptor of suitable type, or the member, the adapter unit, and connector unit may be joined, and the second electrical connection structure may then be joined to an electrical receptor of suitable type.

19. An electrical connector as set forth in claim 18, wherein the conductor is an audio cable.

20. An electrical connector as set forth in claim 18, wherein the first adapter unit attachment structure is a first shaft and the second adapter unit attachment structure is a first bore adapted to engage about the first shaft.

21. An electrical connector as set forth in claim 20, wherein the first shaft is threaded and the first bore is threaded so as to matingly engage with the threads on the first shaft.

22. An electrical connector as set forth in claim 21, wherein the first connector unit attachment structure is a second shaft and the second connector unit attachment structure is a second bore adapted to engage about the shaft.

23. An electrical connector as set forth in claim 22, wherein the second shaft is threaded and the second bore is threaded so as to matingly engage with the threads on the shaft.

24. An electrical connector as set forth in claim 18, wherein second electrical receptor connection structure is not a standard rigid pin connector.

25. An electrical connector as set forth in claim 18, wherein second electrical receptor connection structure is a spade connector or a banana connector.

26. An electrical connector as set forth in claim 18, wherein the first electrical receptor connection structure is a standard rigid pin connector.

27. An electrical connector as set forth in claim 26, wherein second electrical receptor connection structure is not a standard rigid pin connector.

28. An electrical connector as set forth in claim 26, wherein second electrical receptor connection structure is a spade connector or a banana connector.

* * * * *